US006367947B1

(12) United States Patent
Itaya et al.

(10) Patent No.: US 6,367,947 B1
(45) Date of Patent: Apr. 9, 2002

(54) FLUORESCENT LAMP HAVING EXCELLENT LIGHT DISTRIBUTION AND HIGH IMPACT-RESISTANCE

(75) Inventors: Kenji Itaya, Takatsuki; Takeshi Matsumura, Kashiwara; Shiro Iida, Takatsuki; Nobuharu Hata, Kameoka, all of (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/502,365

(22) Filed: Feb. 18, 2000

(30) Foreign Application Priority Data

Feb. 26, 1999 (JP) ..... 11-050028

(51) Int. Cl.[7] ..... F21S 5/00

(52) U.S. Cl. ..... 362/216; 362/225; 362/260; 362/296

(58) Field of Search ..... 362/260, 216, 362/390, 225, 296, 217

(56) References Cited

U.S. PATENT DOCUMENTS 4,521,837 A * 6/1985 Bouchard ..... 362/216
4,885,670 A * 12/1989 Baake ..... 362/216
5,436,814 A * 7/1995 Hanley ..... 362/216
5,436,815 A * 7/1995 Grooms et al. ..... 362/216
5,523,931 A * 6/1996 Kassay et al. ..... 362/235

FOREIGN PATENT DOCUMENTS

JP 4267047 9/1992
JP 998971 8/1997

* cited by examiner

*Primary Examiner*—Thomas M. Sember
(74) *Attorney, Agent, or Firm*—Price and Gess

(57) ABSTRACT

An arc tube is a connected bulb composed of three U-shaped bulbs set annularly and connected by a bridge connector to include one discharge path. A reflector is set in a space enclosed by the three U-shaped bulbs, the bottom end of the reflector being fixed to a holder. The reflector has a conical part, and a cylindrical part whose height is greater than a height of a clearance between the pair of legs of each U-shaped bulb, and smaller than a height of the U-shaped bulb. At least within the height of the clearance between the pair of legs, a diameter of the reflector is greater than both a width of the clearance between the pair of legs and a width of each clearance between neighboring U-shaped bulbs, improving light distribution of the arc tube. A reflector may have a reflective body and a restrictive member integrally formed.

26 Claims, 11 Drawing Sheets light distribution expressed in candelas light distribution expressed in candelas

FLUORESCENT LAMP HAVING EXCELLENT LIGHT DISTRIBUTION AND HIGH IMPACT-RESISTANCE

This application is based on application No. 11-50028 filed in Japan, the content of which is hereby incorporated by reference.

BACKGROUND OF THE INVENTION (1) Field of the Invention

The present invention relates to a fluorescent lamp, and particularly relates to an improvement in the light distribution and impact-resistance of the fluorescent lamp.

(2) Description of Related Art

In general, when a discharge path of a fluorescent lamp is made serpentine, a long discharge path can be formed in a small space, thereby enabling the fluorescent lamp to be miniaturized and to be manufactured as compact as possible.

As one example of such a fluorescent lamp, a bulb-type fluorescent lamp having the following structure is well known. The fluorescent lamp has multiples of U-shaped bulbs or straight bulbs that are set annularly on the upper surface of a holder. The neighboring U-shaped bulbs or straight bulbs are connected to form an arc tube by bridge connection so that a serpentine discharge path is formed as one path. The fluorescent lamp is so provided with an arc tube having the serpentine discharge path, a holder for holding the arc tube, and a base provided at the end of the holder.

This conventional fluorescent lamp has a disadvantage in that a horizontal light distribution of the lamp is likely to be nonuniform. One example of a technique for improving the horizontal light distribution is disclosed in Japanese Laid-Open Patent Application No. 4-267047. The bulb-type fluorescent lamp disclosed in this Application is composed of multiples of U-shaped bulbs set in parallel and a reflective board having a reflective face and being positioned between pairs of legs of the U-shaped bulbs.

This fluorescent lamp is formed by setting the multiples of U-shaped bulbs in parallel. Thus, if this technique is applied to the above-mentioned fluorescent lamp that has the multiples of U-shaped bulbs set annularly, the light distribution may not be adequately improved. Meanwhile, if nothing is provided between the pairs of legs and a reflective cover is attached to the fluorescent lamp, shadow stripes may appear on the surface of the reflective cover.

For the conventional fluorescent lamp, a spacer made of a silicon resin may be set between the neighboring bulbs. By the provision of the spacers, breakages of the bulbs due to impacts, such as an accidental drop during transportation, can be prevented while impact-resistance is ensured. However, manufacture and installation of the spacers increase the materials cost and number of man-hours. Note that "impacts" referred to in this specification means momentary physical shock, such as accidental drop, and also means continuous physical shock, such as a firm grip with a user's hand.

Additionally, even if the spacers are to be installed, they are independent of the holder and the arc tube. This means that the fluorescent lamp is susceptible to impact given to the entire arc tube and so cannot ensure an adequate impact-resistance.

SUMMARY OF THE INVENTION

It is therefore a first object of the present invention to improve the light distribution of a fluorescent lamp that is composed of a plurality of U-shaped bulbs set annularly.

It is a second object of the present invention to provide a fluorescent lamp that can withstand impacts.

The first object of the present invention can be achieved by a fluorescent lamp made up of: an arc tube formed from a plurality of bulbs that are each formed in an inverted U-shape with two substantially straight stems and a curved top and that are joined together into one connected bulb to include one discharge path, an inner surface of each U-shaped bulb being coated with a fluorescent material; a holder having a mounting surface in which the two stems of each U-shaped bulb are planted at positions that lie on an imaginary circle with a roughly the same distance between neighboring U-shaped bulbs; and a light radiating member set in a space enclosed by the holder and the plurality of U-shaped bulbs, and radiating light through each clearance between the two stems and each clearance between neighboring U-shaped bulbs by at least one of reflecting light from the arc tube and emitting light.

With this construction of the fluorescent lamp of the present invention, the light distribution of a fluorescent lamp having a plurality of U-shaped bulbs set annularly can be improved. Also, shadow stripes can be prevented from appearing on the surface of the reflective cover while the lamp is lit up.

Specifically, the light radiating member can be a reflector whose bottom end is fixed to the holder at a center of the imaginary circle, wherein the reflector has a pillar part and a tapered top end, a height of the pillar part measured from the mounting surface being greater than a height of the clearance between the two stems of each U-shaped bulb and smaller than a height of each U-shaped bulb measured from the mounting surface, and wherein, within at least the height of the clearance between the two stems of each U-shaped bulb, a diameter of the reflector is greater than a width of the clearance between the two stems and greater than a width of the clearance between neighboring U-shaped bulbs.

The second object of the present invention can be achieved by a fluorescent lamp made up of: an arc tube formed from a plurality of bulbs that are joined together into one connected bulb to include one discharge path, each inner surface of the plurality of bulbs being coated with a fluorescent material; a holder having a mounting surface in which each mounting end of the bulbs is planted; a supporting member whose bottom end is fixed to the holder on the mounting surface; and a restrictive member that is supported by the supporting member, wherein a positional relationship between the restrictive member and the supporting member is fixed, and that imposes a restriction on the plurality of bulbs so that each bulb substantially remains in an initial position in both horizontal and vertical directions.

With this construction, each bulb will always remain in its initial position in the horizontal and vertical directions by the provision of the restrictive member. The restrictive member also ensures the impact-resistance, thereby making the lamp less prone to breakages resulting from impacts. The restrictive member is situated according to a fixed positional relationship with the supporting member whose bottom end is fixed to the holder, so that the lamp is made resistant to impacts given to the entire arc tube.

It is more preferable for the restrictive member to have one of the following constructions to prevent breakages. The restrictive member preferably has at least two parts that extend from the supporting member and are respectively positioned in a corresponding number of clearances between neighboring bulbs, and each of the at least two parts has an elasticity to absorb a force that is applied to a front of the part in a direction of a space enclosed by the plurality of bulbs. Alternatively, the restrictive member preferably has at least two parts that extend from the supporting member and are respectively positioned in a corresponding number of clearances between neighboring bulbs, and each of the at least two parts has an elasticity to absorb a force that is applied to sides of the restrictive member in a lateral direction.

The supporting member can be a reflector that reflects light from the arc tube. With this reflector, the impact-resistance of the lamp can be ensured and the light distribution can be improved.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF PREFERRED EMBODIMENTS

The following is a description of embodiments of the present invention, with reference to the drawings.

First Embodiment

Figure 1:
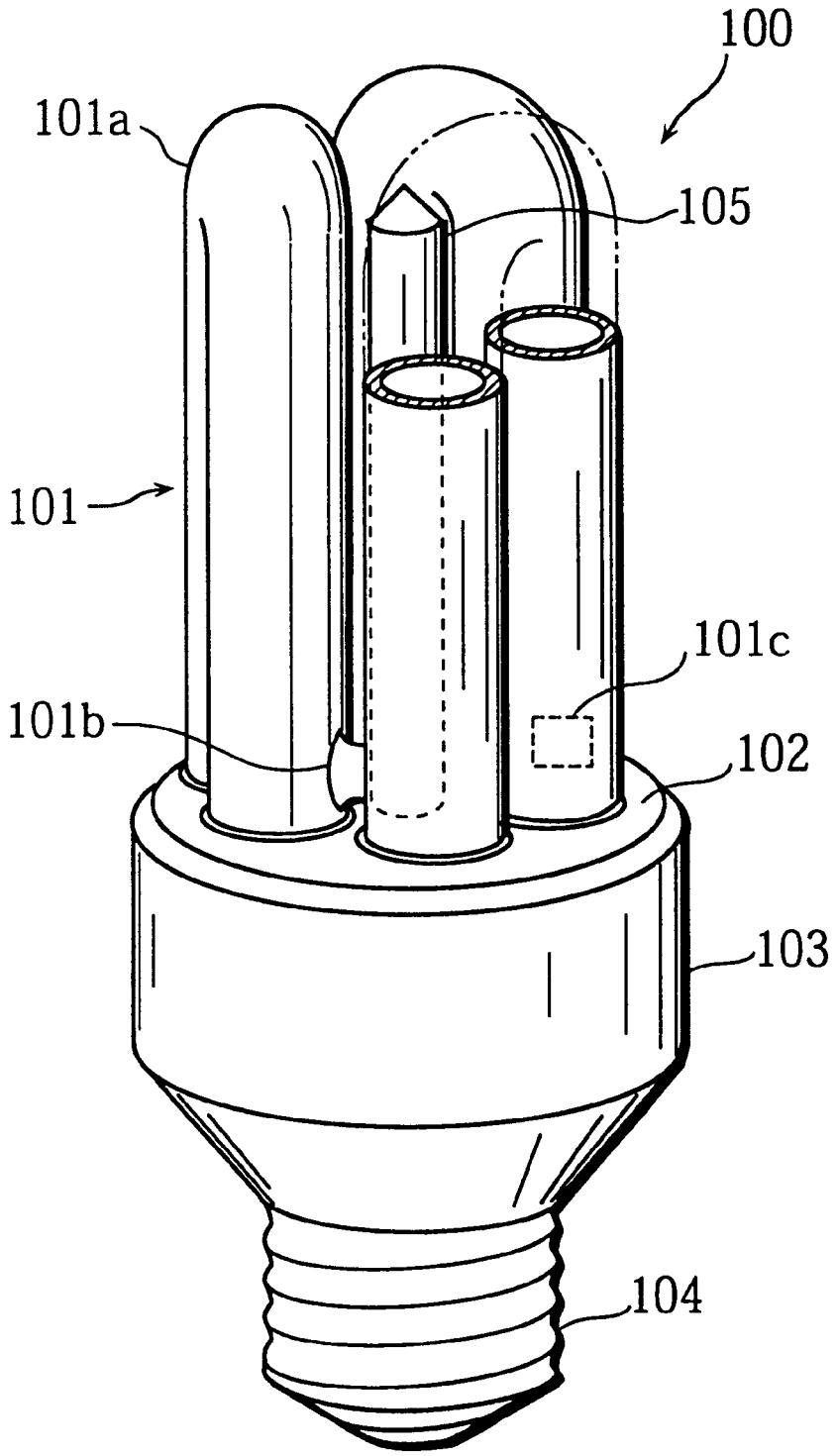
FIG. 1 is a partially cutaway perspective view showing a construction example of a fluorescent lamp of a first embodiment of the present invention.

FIG. 1 is a partially cutaway perspective view showing a construction example of a fluorescent lamp of the first embodiment of the present invention.

As shown in this figure, a fluorescent lamp 100 of the present embodiment is composed of an arc tube 101 having a serpentine discharge path, a holder 102 for holding the arc tube 101, a resin case 103, and a metal base 104 provided at the end of the resin case 103. The resin case 103 houses a lighting circuit (not illustrated) in an inner space located between the resin case 103 and the holder 102, the light circuit being used for lighting up the arc tube 101.

The arc tube 101 is composed of three U-shaped bulbs 101*a* that are set annularly on the holder 102. A bridge connector 101*b* connects neighboring U-shaped bulbs 101*a* so that the three U-shaped bulbs 101*a* are formed into one connected bulb. Fluorescent material is applied on each inner surface of the U-shaped bulbs 101*a*. Electrodes 101*c* and 101*d* (101*d* is not shown in FIG. 1) are respectively provided at the ends of the connected bulb, forming a serpentine discharge path between the electrodes 101*c* and 101*d*.

In the present embodiment, a reflector 105 that is made of a white resin and supported by the holder 102 at one end is set in a space enclosed by the holder 102 and the three U-shaped bulbs 101*a*. By the provision of the reflector 105, the light distribution of the fluorescent lamp 100 is improved. The detailed explanation for the reflector 105 is given as follows.

Figure 2:
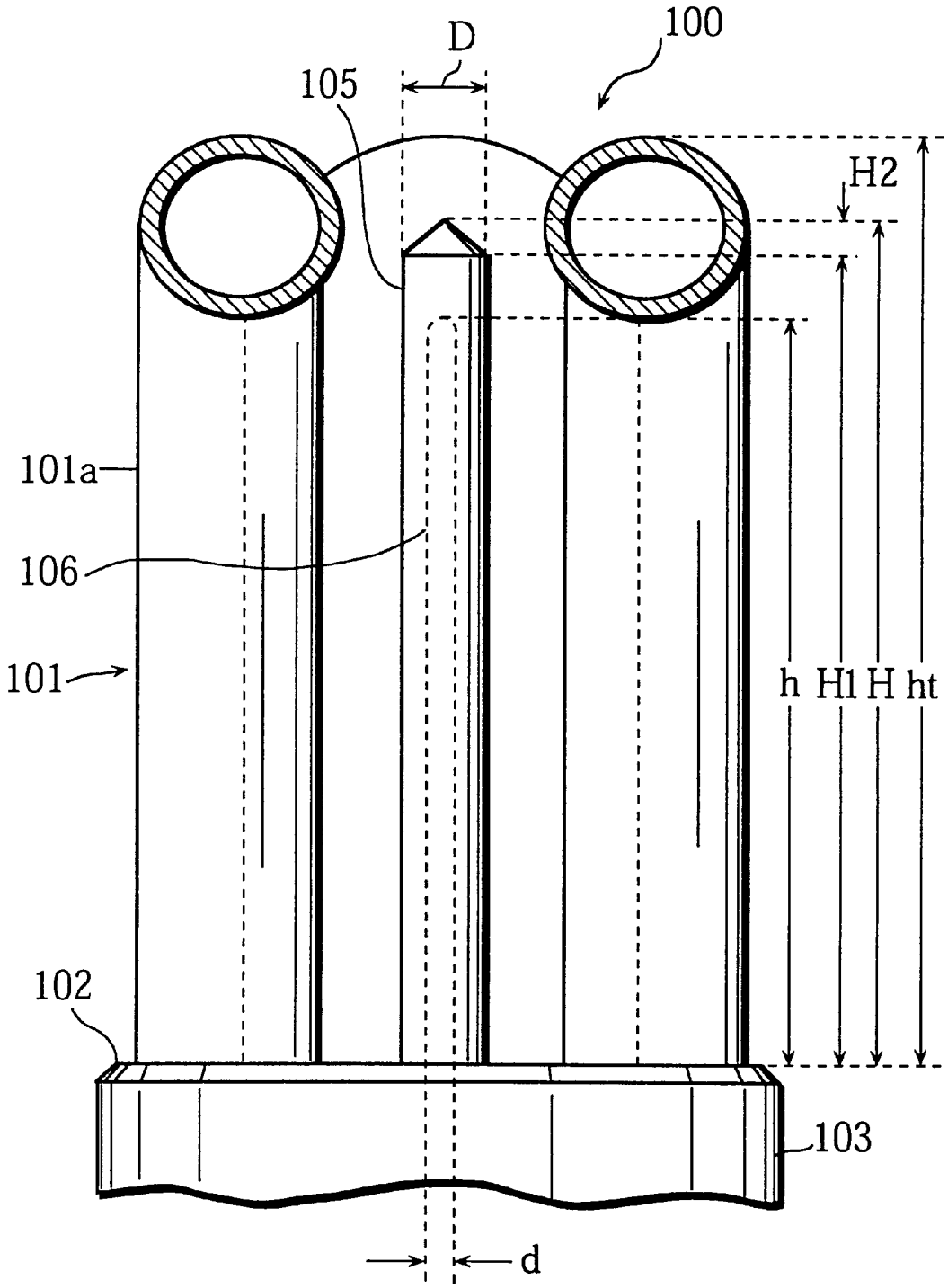
FIG. 2 is a partially cutaway front view to help explain details of the shape of a reflector 105 of the first embodiment of the present invention.

FIG. 2 is a partially cutaway front view to help explain details of the shape of the reflector 105 of the present embodiment. In FIG. 2, the same components as those shown in FIG. 1 are assigned the same number as indicated in FIG. 1.

The reflector 105 of the present embodiment has a conical part and a cylindrical part. In FIG. 2, a width of a clearance 106 between the two legs of each U-shaped bulb 101*a* is referred to as d, a height of the clearance 106 is referred to as h, a diameter of the cylindrical part of the reflector 105 is referred to as D, a height of the reflector 105 is referred to as H, a height of the cylindrical part is referred to as H1, a height of the conical part is referred to as H2, and a height of the U-shaped bulb 101*a* is referred to as ht. Note that all of the heights are measured from the upper surface of the holder 102.

As shown in FIG. 2, the reflector 105 is constructed so that the diameter D of the cylindrical part is greater than the width d of the clearance 106 within the height h of the clearance 106 (meaning that the diameter D can be set smaller than the width d above the clearance 106), and that the height H1 of the cylindrical part is greater than the height h of the clearance 106.

Although not illustrated in FIG. 2, the diameter D is also set greater than a width of each clearance between the neighboring U-shaped bulbs 101*a* within the height h.

Nonuniformity in the horizontal light distribution is caused due to the presences of the clearances 106 between the two legs of each U-shaped bulb 101*a* and clearances between the neighboring U-shaped bulbs 101*a*. However, by satisfying the relations among the diameter, widths, and heights, the nonuniformity can be corrected. The light distribution of the upper part of the lamp can be also improved since the top end of the reflector 105 is conical in shape. Accordingly, even when a reflective cover is attached to the fluorescent lamp 100, shadow stripes are prevented from appearing on the surface of the reflective cover.

When the fluorescent lamp 100 is viewed from the front, the reflector 105 looks as if filling the clearance 106 and each clearance between the neighboring U-shaped bulbs. Hence, improvement in the horizontal light distribution can be achieved. As can be understood, the reflector 105 is not limited to having a conical part and a cylindrical part. The reflector 105 may have a polygonal-pyramid and a polygonal prism. As one example, the reflector 105 may be composed of a hexagonal pyramid and a hexagonal prism. The diameter of the cylindrical part or the width of the prism does not necessarily need to be constant along its length. For example, the reflector 105 may taper off to a point. It should be noted here, however, that it is preferable to set the height H1 of the prism smaller than the height ht of the U-shaped bulb 101*a* for the improvement in the light distribution for the upper part of the fluorescent lamp 100.

Figure 3:
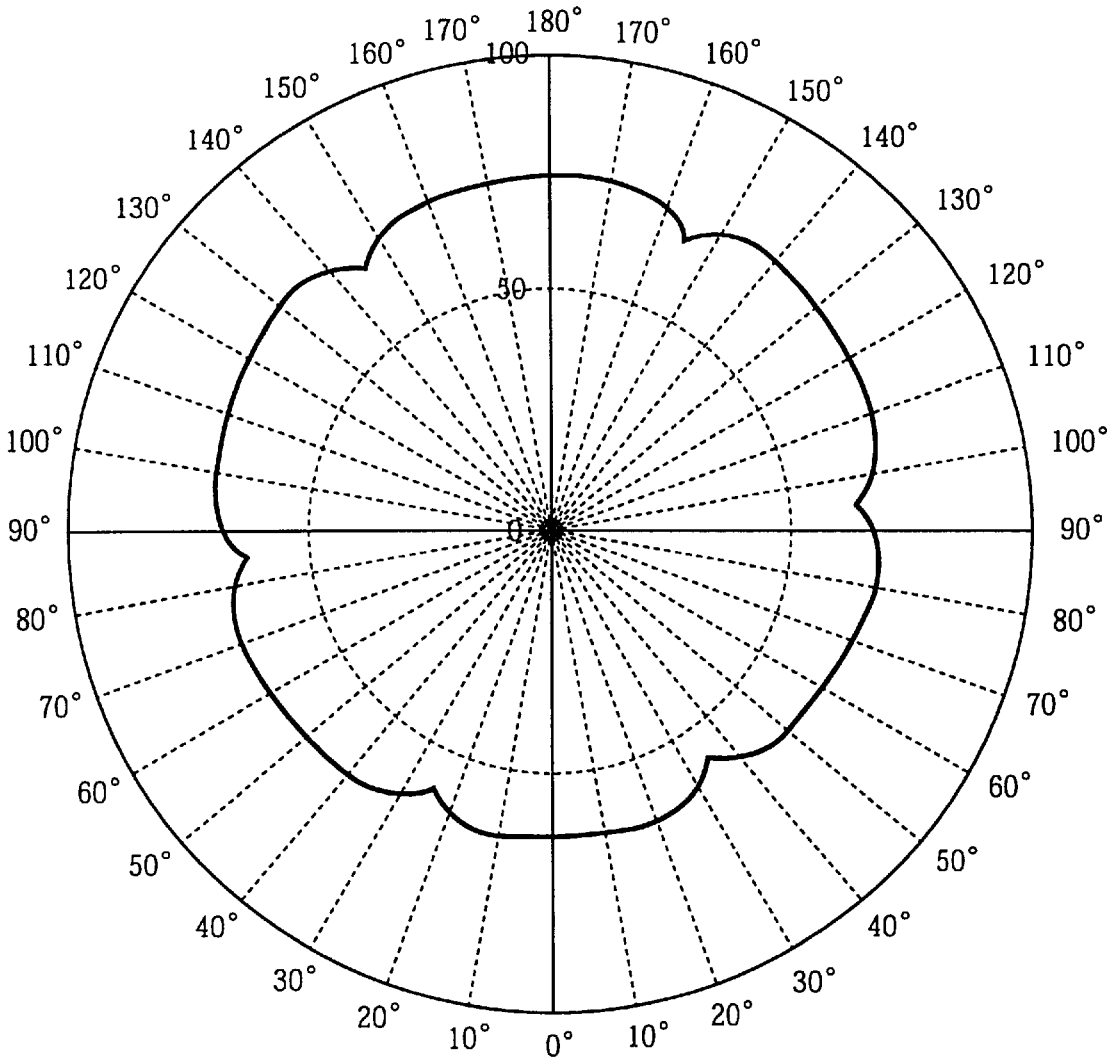
FIG. 3 shows a horizontal light distribution of a fluorescent lamp that is not provided with the reflector 105.
Figure 4:
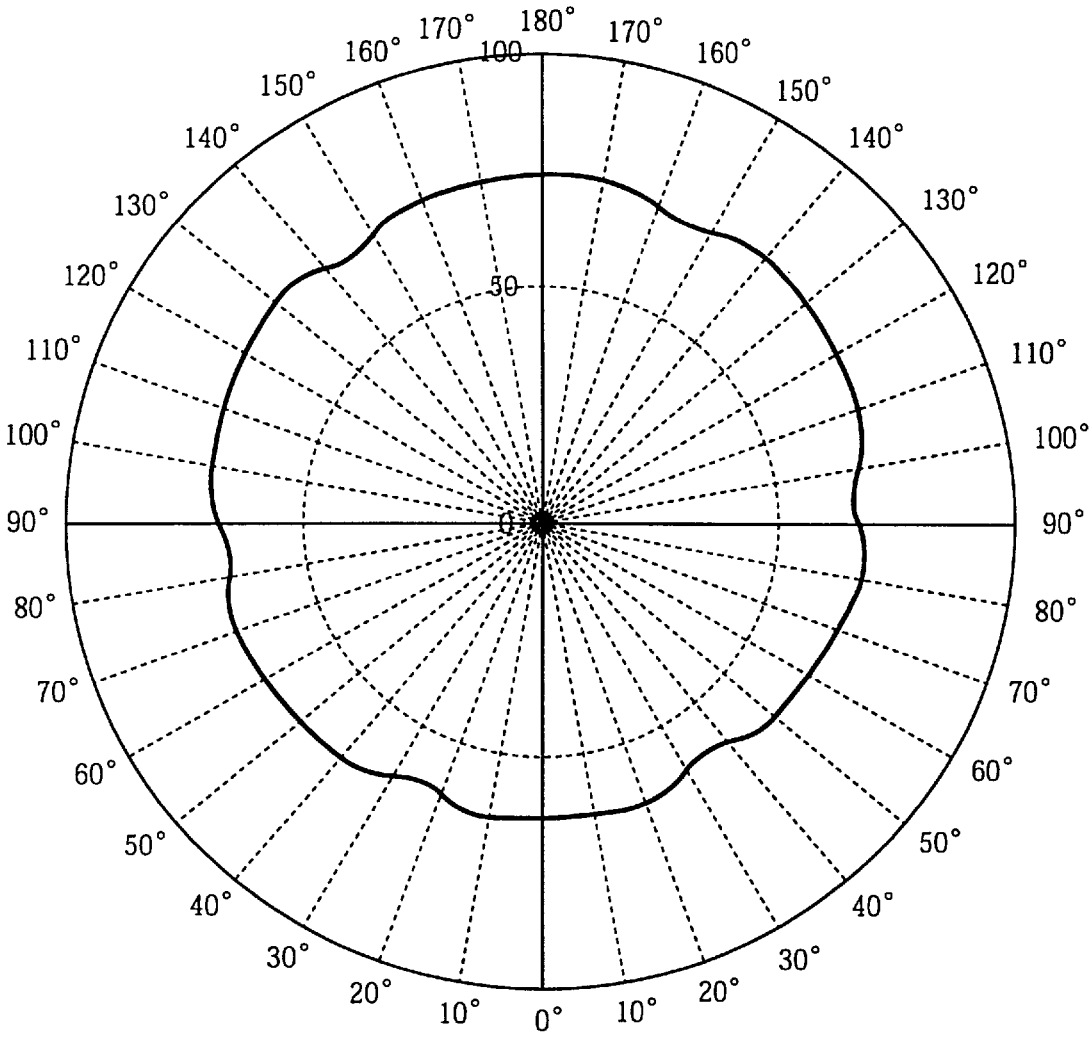
FIG. 4 shows a horizontal light distribution of a fluorescent lamp that is provided with the reflector 105.

An experiment was conducted on the light distribution using two fluorescent lamps. One fluorescent lamp had the stated construction and was provided with the reflector 105 as is the case of the fluorescent lamp 100 of the present embodiment, while the other fluorescent lamp was not provided with the reflector 105. FIG. 3 shows a horizontal light distribution of the fluorescent lamp that was not provided with the reflector 105, while FIG. 4 shows a horizontal light distribution of the fluorescent lamp that was provided with the reflector 105. As shown in FIG. 4, the light distribution was improved as compared with that shown in FIG. 3 at 25°, 85°, and 145° angles of the left side and at 35°, 95°, and 155° angles of the right side with respect to a 0° angle that is set as the downward direction in this figure. To be more specific, the horizontal light distribution at the parts corresponding to the clearances 106 and clearances between the neighboring U-shaped bulbs were improved.

Accordingly, the light distribution is improved using the fluorescent lamp 100 of the present embodiment. When a reflective cover is attached to the fluorescent lamp 100, for example, shadow stripes due to nonuniformity in the light distribution are prevented from appearing on the surface of the reflective cover. The reflector 105 may be fixed to the holder 102 from the arc tube (101) side. Alternatively, the reflector 105 may be set, passing through the surface of the holder 102 from below and fixed to the holder 102.

In the case where the reflector 105 is fixed to the holder 102 from the arc tube side, the reflector 105 may be secured to the holder 102 using an adhesive. Or, as described later in this specification, a stopper may be provided at the lower end of the reflector 105 and fixed into a stopper holding unit provided in the holder 102.

In the present embodiment, an explanation has been given for a case where the fluorescent lamp 100 has three U-shaped bulbs 101*a*. However, as long as U-shaped bulbs are set annularly, the number of the U-shaped bulbs is not limited to three. For example, the number of the U-shaped bulbs may be four. In this case, the four U-shaped bulbs are set on the holder 102, forming a rough square.

Second Embodiment

In the second embodiment, a fluorescent lamp having an appropriate impact-resistance that enables the lamp to be resistant to impacts is described. The fluorescent lamp of the present embodiment can also ensure the uniform light distribution as in the case of the first embodiment.

Figure 5:
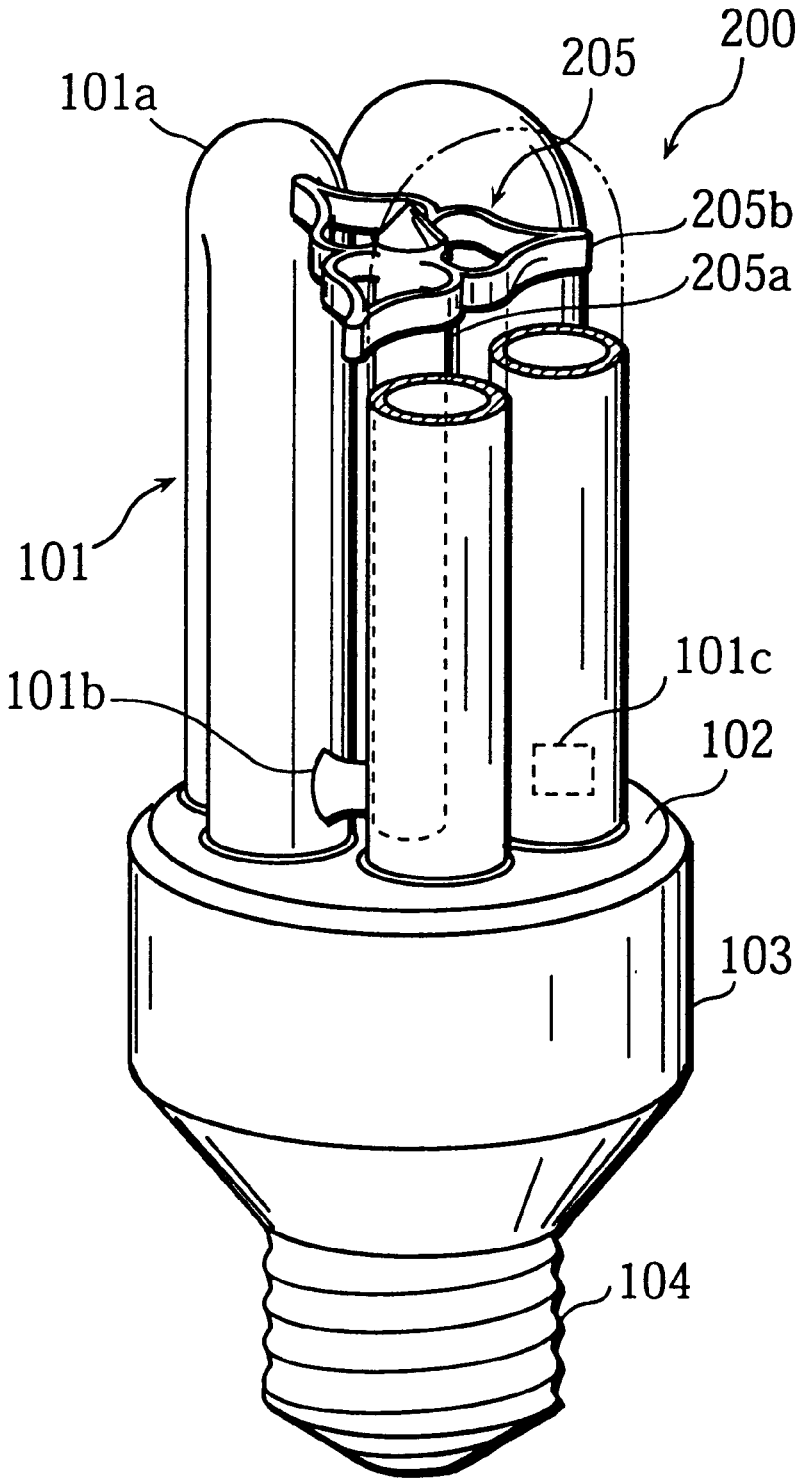
FIG. 5 is a partially cutaway perspective view showing a construction example of a fluorescent lamp of a second embodiment of the present invention.

FIG. 5 is a partially cutaway perspective view showing a construction example of a fluorescent lamp 200 of the present embodiment.

As shown in FIG. 5, the fluorescent lamp 200 is the same as the fluorescent lamp 100 of the first embodiment in that the reflector ("205" in the second embodiment) made of a white resin is set in a space enclosed by the holder 102 and the three U-shaped bulbs 101*a*. However, the reflector 205 of the present embodiment is composed of a reflective body 205*a* and three restrictive members 205*b*. Points of leaf-shaped parts of the restrictive members 205*b* are respectively positioned in the clearances between the neighboring U-shaped bulbs 101*a*.

The lower end, situated opposite to the restrictive members 205*a*, of the reflective body 205*a* is fixed to the holder 102 as is the case with the first embodiment. By the presences of the restrictive members 205*b* between the neighboring U-shaped bulbs 101*a*, so that each U-shaped bulb 101*a* always substantially remains in its initial position in the horizontal and vertical directions. More specifically, each restrictive member 205*b* is provided with cushioning against impacts. Thus, the lamp 200 can be prevented from being broken due to impacts.

Accordingly, the light distribution of the lamp 200 is improved and the impact-resistance can be ensured without using a separate member, such as a spacer. This enables the materials cost and number of man-hours to be reduced, thereby increasing productivity. Additionally, since the positional relation between the reflective body 205*a* and the restrictive members 205*b* is fixed, the impact-resistance can be provided to withstand an impact, such as a firm grip with a user's hand, that is given to the entire lamp 200.

In the present embodiment, the three restrictive members 205*b* are provided corresponding to the three clearances between the neighboring U-shaped bulbs 101*a*. However, the number of restrictive members 205*b* is not limited to three. A necessary level of effect can be obtained if at least two restrictive members 205*b* are provided.

Figure 7:
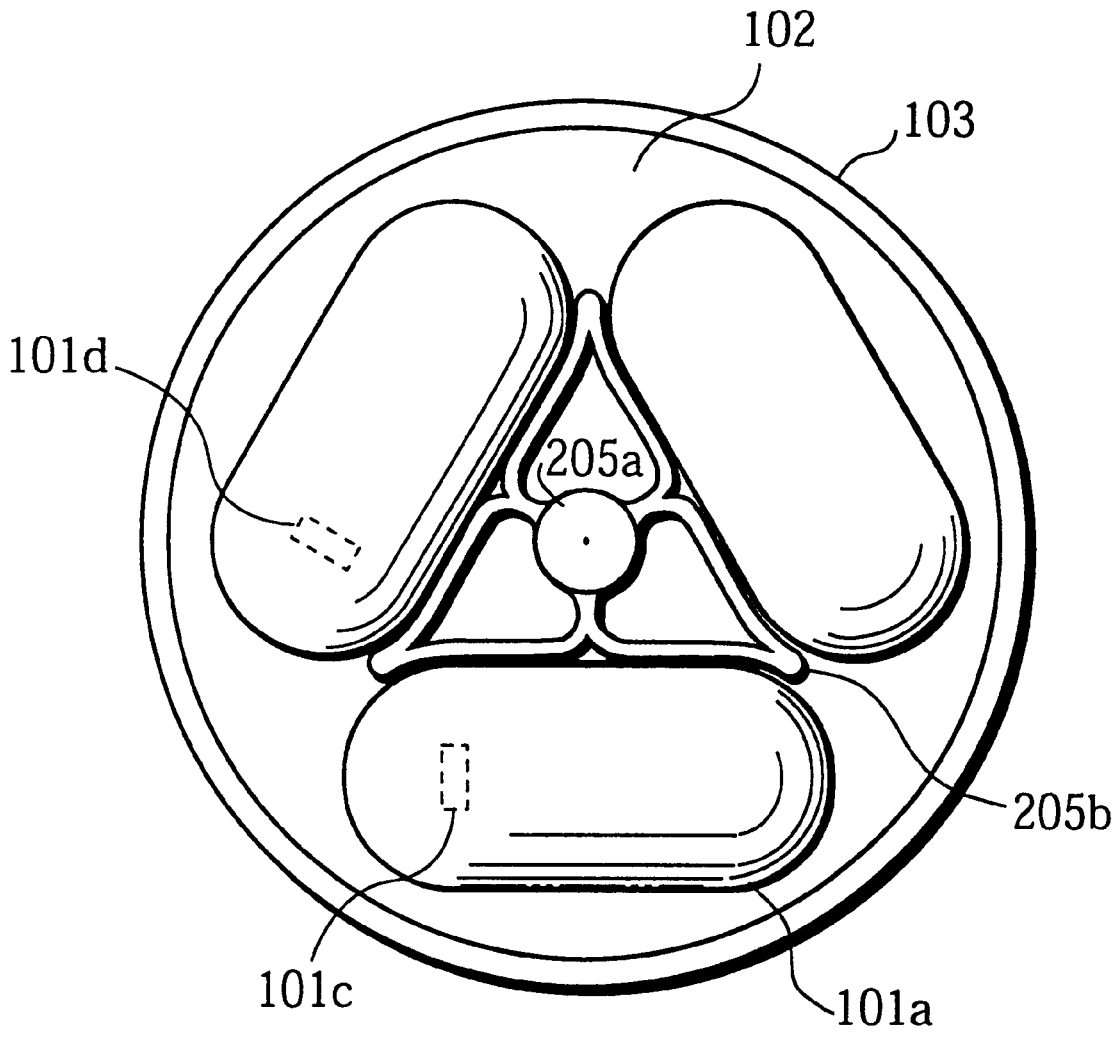
FIG. 7 is a top plan view to help explain the shape of a restrictive member 205*b* of the second embodiment.
Figure 8:
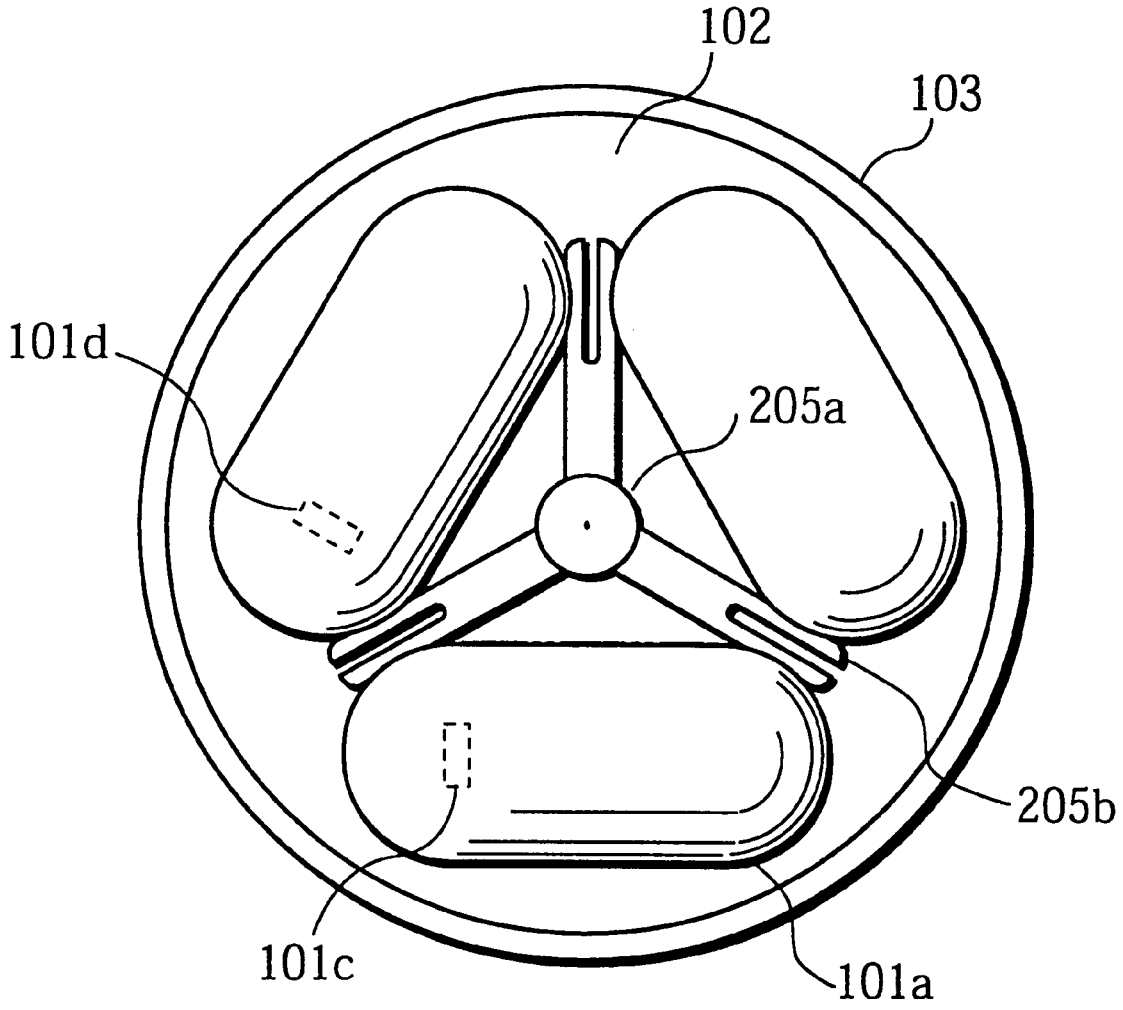
FIG. 8 is a top plan view to help explain another shape example of the restrictive member 205*b;*
Figure 9:
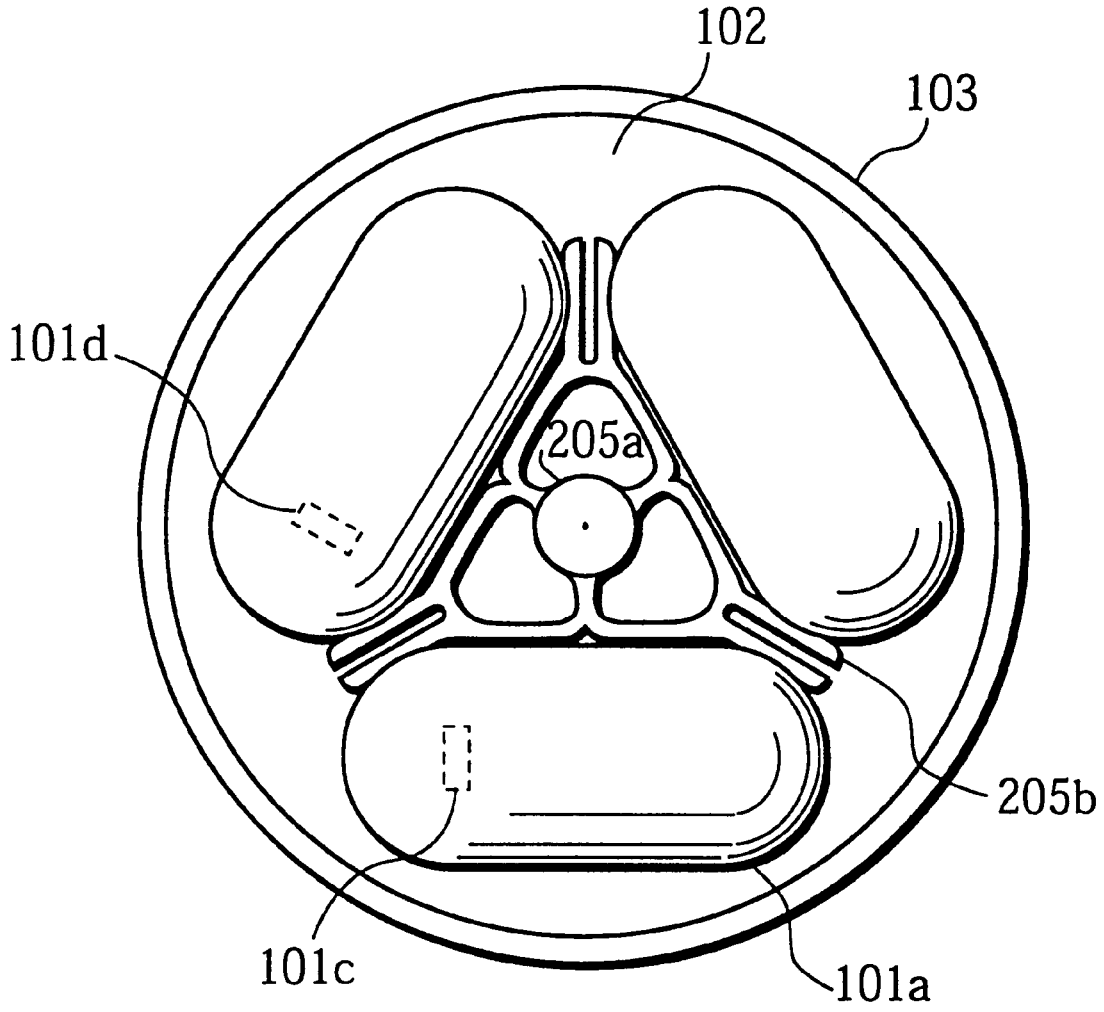
FIG. 9 is a top plan view to help explain another shape example of the restrictive member 205*b;*

The point of leaf-shaped part of the restrictive member 205*b* that is positioned in the corresponding clearance is not limited to this shape as shown in FIG. 5. Other shape examples of the restrictive member 205*b* are shown in FIGS. 7, 8, and 9. FIG. 7 is a top plan view to help explain a shape example of the restrictive member 205*b*. With this shape of the restrictive member 205*b* shown in FIG. 7, a force applied from the front of the point of the restrictive member 205*b* in the direction of the reflective body 205*a* is absorbed by the elasticity provided for the restrictive member 205*b*. FIG. 8 is also a top plan view showing another shape example. As shown in this figure, a slit is provided for each restrictive member 205*b* so as to enable the restrictive member 205*b* to have the elasticity against a force applied from the sides in a lateral direction. As a further example, FIG. 9 shows a case where each restrictive member 205*b* is provided with the elasticity that can absorb forces applied from the front and sides of the restrictive member 205*b*.

Figure 10:
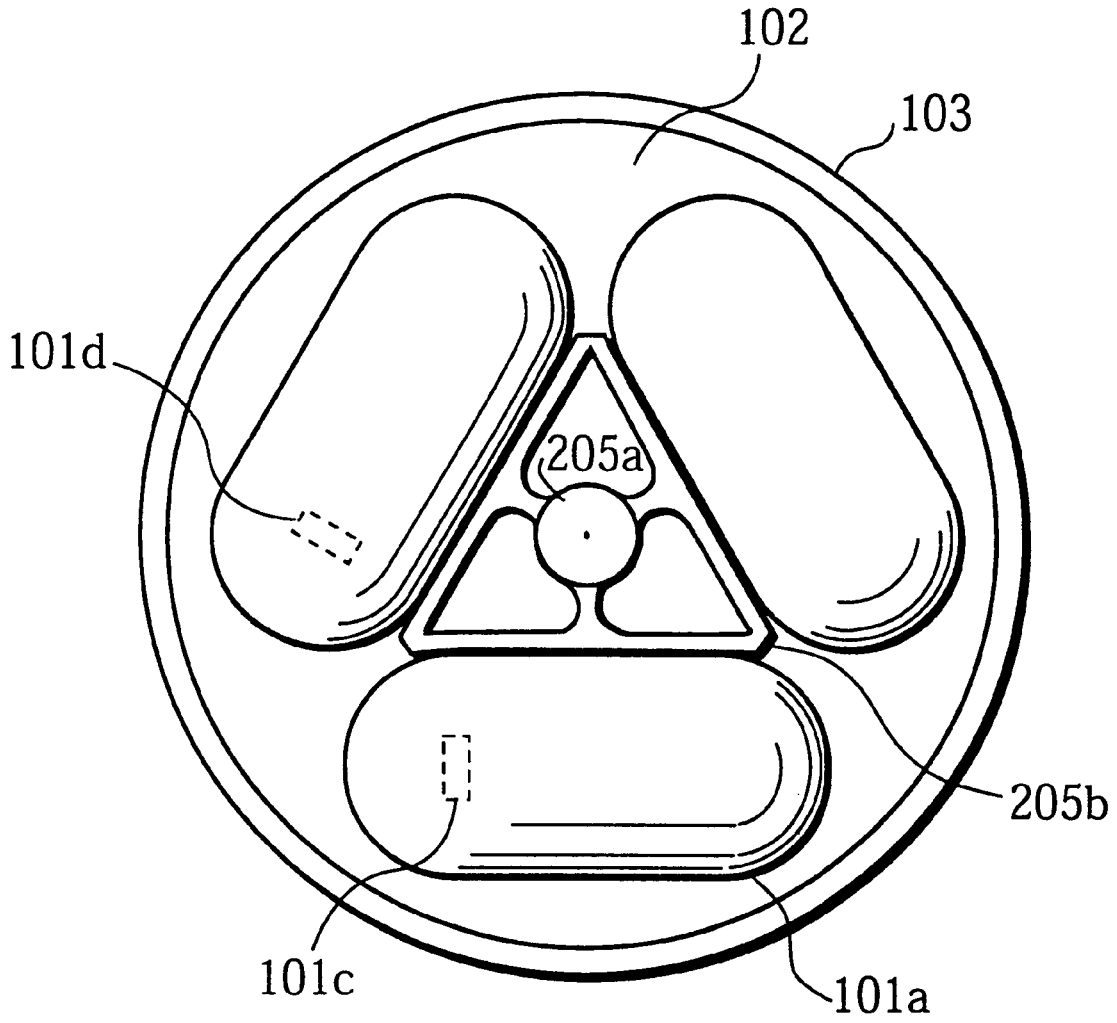
FIG. 10 is a top plan view to help explain another shape example of the restrictive member 205*b,* no parts of the restrictive member 205*b* being located between the bulbs.

Alternatively, as shown in FIG. 10, the restrictive member 205*b* having no parts to be positioned in the clearances can be used. With this shape of the restrictive member 205*b*, it is considered that each U-shaped bulb 101*a* will always substantially remain in its initial position in the horizontal and vertical directions and that breakages due to impacts can be appropriately prevented. However, it is still preferable for the restrictive member 205*b* to have appropriate elasticity.

The restrictive member 205*b* having the shape shown in FIG. 8 and not provided with a slit may be used. It should be noted that all of the restrictive members 205*b* having the various shapes as stated above are not necessarily in contact with the adjacent U-shaped bulbs 101*a*. Although the impact-resistance of the U-shaped bulb 101*a* itself has to be considered here, a necessary level of the impact-resistance can be obtained if the U-shaped bulb 101*a* substantially remains in its initial position to avoid breakage due to impacts.

In the present embodiment, the restrictive members 205*b* and the reflective body 205*a* for supporting the restrictive member 205*b* are made of white resins and formed in one piece. The present embodiment is preferable in that the light distribution is improved as well as in that the impact-resistance is ensured. However, the present invention is not limited to the present embodiment. If only the impact-resistance is required to prevent breakages, the member to be used for supporting the restrictive members 205*b* does not have to reflect light. More specifically, according to the purpose of use, a black supporting member that is not reflective may replace the reflective body 205*a*, and the restrictive members 205*b* made of material different from the supporting member may be fixed to the supporting member.

Modifications

The present invention has been described in accordance with the preceding embodiments and their modified examples. It should be obvious that the present invention is not limited to these embodiments and modified examples, so that the following modifications can be made.

(1) In the preceding embodiments, an arc tube 101 has three U-shaped bulbs 101*a* that are bridge-connected. However, in the second embodiment, the shape of the bulb is not limited to the U-shape. An arc tube may have a plurality of straight bulbs whose ends are bridge-connected and a serpentine discharge path may be provided in the bridge-connected bulb. The restrictive members 205*b* of the second embodiment are used for preventing breakages by restricting the positional relation between the neighboring bulbs. Therefore, the size of each clearance between the neighboring bulbs is not particularly limited. The widths of the clearances may be different for each clearance although a level of effect to be obtained may vary depending on the width of the clearance. It should be obvious that the number of bulbs to be used for forming a bridge-connected bulb is not limited.

(2) As the reflector 205 of the second embodiment, the body 205*a* and the member 205*b* may be formed as one piece. Alternatively, the reflective body 205*a* and the restrictive member 205*b* may be separately made and then formed into one piece later. In the latter case, the reflective body 205*a* and the restrictive member 205*b* may be formed from the same material or different materials.

Figure 6:
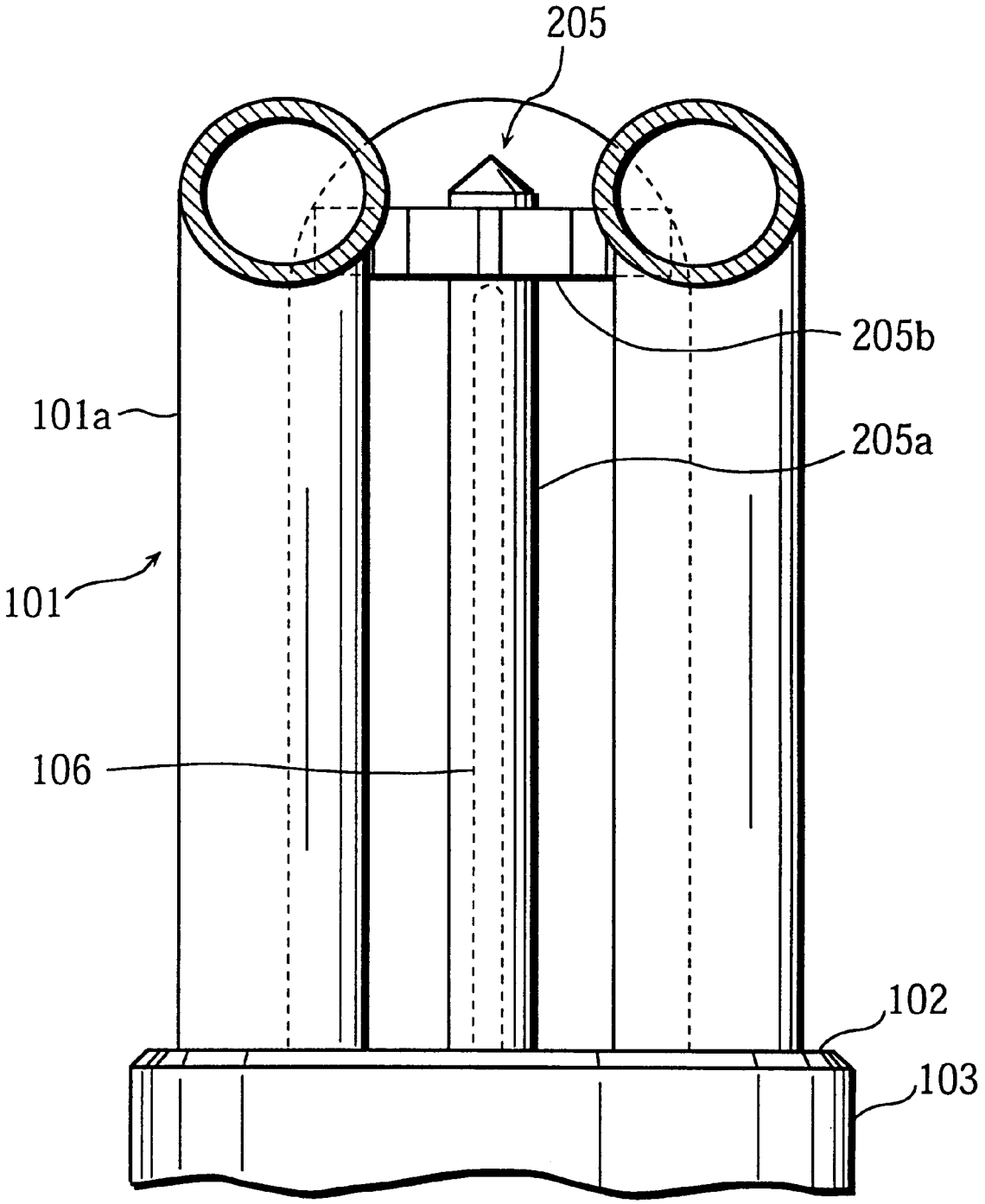
FIG. 6 is a partially cutaway front view to help explain details of the shape of a reflector 205 of the second embodiment of the present invention.

(3) As shown in FIG. 6 of the second embodiment, the restrictive member 205*b* is fixed to the reflective body 205*a* so to be located higher than the top end of the clearance 106 between the two legs of each U-shaped bulb 101*a* and lower than the top end of the U-shaped bulb 101*a*. This particular position of the restrictive member 205*b* is preferable in terms of the improvement in the light distribution of the lamp 200. However, the position of the restrictive member 205*b* is not limited to this. With an eye to the prevention of breakages, it is preferable to position the restrictive member 205*b* so that it is at least half the height of the U-shaped bulb 101*a* away from the holder 102.

(4) A material to be used for making the reflectors 105 and 205, especially for making the reflective body 205*a,* is not limited to the white resin. For the improvement in the light distribution at the same level as described in the preceding embodiments, a member to be used as the reflector 105 or 205 may be made of material, such as a resin, glass, and metal as long as the material has reflection effect. Alternatively, a member with a reflective coating may be used. Moreover, a glass tube whose inner surface is covered with fluorescent material may be used. Or, a member whose outer surface is covered with fluorescent material may be used. Although considered as an extreme case, the light distribution can be improved by setting a light emitter, such as a light bulb, instead of the reflector 101 or 205. When only the impact-resistance is required without having to improve the light distribution in the second embodiment, material having no reflection effects may be used.

Figure 11:
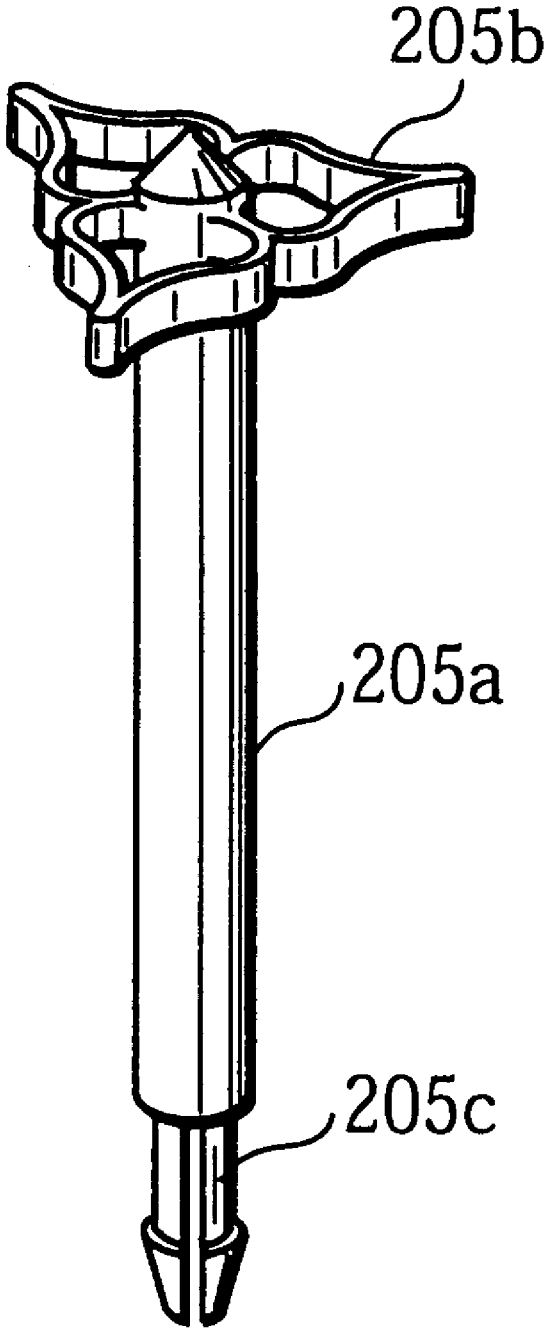
FIG. 11 shows an example of the reflector 205 which has a snap-in stopper 205*c*.

(5) A stopper may be provided at the end of the reflector 105 or the reflective body 205*a,* and a stopper holding unit may be provided in the holder 102. The stopper may be made of a resin, such as polyethylene terephthalate (PET) or polybutylene terephthalate (PBT). By the provision of the stopper and the stopper holding unit, the reflector 105 or the reflective body 205*a* does not need to be fixed to the materials cost and number of man-hours to be reduced, thereby increasing productivity. FIG. 11 shows an example of the reflector 205 that is provided with a snap-in stopper 205*c,* with the reflector 205 being associated with that shown in FIG. 5. This snap-in stopper 205*c* may be provided on the holder 102 and inserted into a hole set in the reflector 105.

(6) The surface of the reflector 105 or 205 may be coated with a layer as a protection against heat or ultraviolet rays. Additionally, the holder 102 and the reflector 105 or 205 may be formed in one piece.

(7) In the preceding embodiments, a description has been given for a case where the fluorescent lamp of the present invention is applied to a bulb-type fluorescent lamp that has the holder 102 mounted to the resin case 103 with the metal base 104. However, the present invention is not limited to a bulb-type fluorescent lamp having a case with a base. For example, the holder 102 may be directly attached to a wall or ceiling.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fluorescent lamp comprising:

an arc tube formed from a plurality of bulbs that are each formed in an inverted U-shape with two substantially straight stems and a curved top and that are joined together into one connected bulb to include one discharge path, an inner surface of each U-shaped bulb being coated with a fluorescent material;

a holder having a mounting surface in which the two stems of each U-shaped bulb are planted at positions that lie on an imaginary circle with a roughly same distance between neighboring U-shaped bulbs; and a reflector is positioned in a space enclosed by the holder and the plurality of U-shaped bulbs, and radiates light through each clearance between the two stems and each clearance between neighboring U-shaped bulbs by reflecting light from the arc tube, wherein a bottom end of the reflector is fixed to the holder at a center of the imaginary circle, wherein the reflector has a pillar part and a tapered top end, a height of the pillar part measured from the mounting surface being greater than a height of the clearance between the two stems of each U-shaped bulb and smaller than a height of each U-shaped bulb measured from the mounting surface; and wherein, within at least the height of the clearance between the two stems of each U-shaped bulb, a diameter of the reflector is greater than a width of the clearance between the two stems and greater than a width of the clearance between neighboring U-shaped bulbs.

2. The fluorescent lamp of claim 1, wherein the tapered top end of the reflector is conical and the pillar part of the reflector is cylindrical.

3. The fluorescent lamp of claim 1, wherein the tapered top end of the reflector is a polygonal pyramid and the pillar part of the reflector is a polygonal prism.

4. The fluorescent lamp of claim 1, wherein the reflector has a stopper at the bottom end and is fixed to the holder by setting the stopper into a stopper holding unit provided in the holder.

5. A fluorescent lamp comprising:

an arc tube formed from a plurality of bulbs that are joined together into one connected bulb to include one discharge path, each inner surface of the plurality of bulbs being coated with a fluorescent material;

a holder having a mounting surface in which each mounting end of the bulbs is planted;

a supporting member whose bottom end is fixed to the holder on the mounting surface wherein the supporting member is a reflector that reflects light from the arc tube; and a restrictive member that is supported by the supporting member, wherein a positional relation between the restrictive member and the supporting member if fixed, and that imposes a restriction on the plurality of bulbs so that the bulbs remain at least a predetermined distance apart, wherein at least one of the plurality of bulbs is formed in an inverted U-shaped with two substantially straight stems and a curved top, and wherein the restrictive member is supported by the supporting member so that a distance between the restrictive member and the mounting surface of the holder is greater than a height of a clearance between the two stems of each U-shaped bulb and that the distance is smaller than a height of the U-shaped bulb measured from the mounting surface of the holder.

6. The fluorescent lamp of claim 5, wherein the mounting ends of the plurality of bulbs are planted at positions that lie on an imaginary circle with a roughly same distance between neighboring bulbs, and wherein, within at least the height of the clearance between the two stems of each U-shaped bulb, a diameter of the reflector is greater than a width of the clearance between the two stems and greater than a width of the clearance between neighboring U-shaped bulbs.

7. The fluorescent lamp of claim 6, wherein the supporting member has a pillar part and a tapered top end, wherein the restrictive member is fixed to the pillar part of the supporting member.

8. The fluorescent lamp of claim 7, wherein the tapered top end of the supporting member is conical and the pillar part of the supporting member is cylindrical.

9. The fluorescent lamp of claim 7, wherein the tapered top end of the supporting member is a polygonal pyramid and the pillar part of the supporting member is a polygonal prism.

10. The fluorescent lamp of claim 9, wherein the restrictive member extends from at least two faces of the polygonal prism into the clearances between neighboring bulbs.

11. The fluorescent lamp of claim 5, wherein the restrictive member has at least two parts that extend from the supporting member and are respectively positioned in a corresponding number of clearances between neighboring bulbs and each of the at least two parts has an elasticity to absorb a force that is applied to a front of the part in a direction of a space enclosed by the plurality of bulbs.

12. The fluorescent lamp of claim 11, wherein the restrictive member has parts that are respectively positioned in clearances between neighboring bulbs and each of the parts has an elasticity to absorb a force that is applied to sides of the restrictive member in a lateral direction.

13. The fluorescent lamp of claim 5, wherein the restrictive member has at least two parts that extend from the supporting member and are respectively positioned in a corresponding number of clearances between neighboring bulbs and each of the at least two parts has an elasticity to absorb a force that is applied to sides of the restrictive member in a lateral direction.

14. The fluorescent lamp of claim 5, wherein the supporting member is made of a resin.

15. The fluorescent lamp of claim 5, wherein the supporting member and the restrictive member are formed in one piece.

16. The fluorescent lamp of claim 5, wherein the supporting member has a stopper at the bottom end and is fixed to the holder by setting the stopper into a stopper holding unit provided in the holder.

17. The fluorescent lamp of claim 5, wherein the restrictive member is positioned in a clearance where at least a joint unit for joining neighboring bulbs exists.

18. An improved light support fixture for supporting a light emitting assembly having a plurality of spaced light emitting tubes, comprising:

a base member for supporting the plurality of spaced light emitting tubes to extend from the base member;

a light reflecting member positioned within the plurality of spaced light emitting tubes and of a dimension to block any line of sight from one side to the other side of and between the plurality of spaced light emitting tubes to thereby provide a substantially uniform emission of light about a 360° distribution traverse to the extension of the plurality of spaced light emitting tubes; and a resilient spacer unit supported on the light reflecting member and contacting each of the plurality of spaced light emitting tubes to provide support traverse to the extension of the plurality of spaced light emitting tubes.

19. The improved light support fixture of claim 18, wherein the resilient spacer includes bifurcated arms pressing adjacent light emitting tubes.

20. The improved light support fixture of claim 18, wherein the resilient spacer includes a cross-sectional triangular structure cantilevered from the light reflecting member.

21. The improved light support fixture of claim 20, wherein the triangular structure has a hollow interior.

22. An improved light support fixture for supporting a light emitting assembly having a plurality of U-shaped spaced light emitting tubes, comprising:

a base member for supporting the plurality of U-shaped spaced light emitting tubes cantilevered from the base member;

a light reflecting member positioned within the plurality of spaced light emitting tubes and of a dimension to block any line of sight between each opening of the U-shaped tubes from one side to the other side of and between the plurality of spaced light emitting tubes to thereby provide a substantially uniform emission of light about a 360° distribution traverse to the cantilevered extension of the plurality of spaced light emitting tubes; and a resilient spacer unit supported on the light reflecting member and contacting each of the plurality of spaced light emitting tubes to provide support traverse to the cantilevered extension of the plurality of spaced light emitting tubes.

23. The improved light support fixture of claim 22, wherein the resilient spacer includes a cross-sectional triangular structure cantilevered from the light reflecting member.

24. The improved light support fixture of claim 23, wherein the triangular structure has a hollow interior.

25. A fluorescent lamp comprising:

an arc tube formed from a plurality of bulbs that are each formed in an inverted U-shape with two substantially straight spaced apart stems interconnected with a curved top and that are joined together into one connected bulb to include one discharge path, an inner surface of each U-shaped bulb being coated with a fluorescent material;

a holder having a mounting surface in which the two stems of each U-shaped bulb are planted at positions that lie on an imaginary circle with an approximately common distance between neighboring U-shaped bulbs;

an elongated reflector set in a space enclosed by the holder and the plurality of U-shaped bulbs and extending from the holder to the respective cured tops, and radiating light through each spaced clearance between the two stems and each clearance between neighboring U-shaped bulbs by reflecting light from the arc tube; and a resilient spacer unit supported on the reflector set and having at least three radially extending members for contacting respectively a pair of adjacent bulbs for supporting the same.

26. The fluorescent lamp of claim 25 wherein the elongated reflector set has a lower snap-in stopper for engaging the holder.

* * * * *